US011116367B2

(12) United States Patent
Ming et al.

(10) Patent No.: US 11,116,367 B2
(45) Date of Patent: Sep. 14, 2021

(54) ELECTRIC FAN AND VACUUM CLEANER HAVING SAME

(71) Applicant: MiDEA GROUP CO., LTD., Foshan (CN)

(72) Inventors: Lele Ming, Foshan (CN); Xiaowen Hu, Foshan (CN); Hui Zhang, Foshan (CN); Xiaoyin Han, Foshan (CN)

(73) Assignee: MIDEA GROUP CO., LTD., Foshan (CN)

( * ) Notice: Subject to any disclaimer, the term of this patent is extended or adjusted under 35 U.S.C. 154(b) by 438 days.

(21) Appl. No.: 16/233,116

(22) Filed: Dec. 27, 2018

(65) Prior Publication Data

US 2019/0125146 A1 May 2, 2019

Related U.S. Application Data

(63) Continuation of application No. PCT/CN2017/083114, filed on May 4, 2017.

(30) Foreign Application Priority Data

Mar. 13, 2017 (CN) ..... 201710146107.0

(51) Int. Cl.

| | |
|---|---|
| ***A47L 5/22*** | (2006.01) |
| ***A47L 9/22*** | (2006.01) |
| ***F04D 29/44*** | (2006.01) |
| ***F04D 29/24*** | (2006.01) |

(Continued)

(52) U.S. Cl.

CPC ..... *A47L 5/22* (2013.01); *A47L 9/22* (2013.01); *A47L 9/2842* (2013.01); (Continued)

(58) Field of Classification Search

CPC ..... A47L 5/22; A47L 9/22; A47L 9/2842; F04D 17/165; F04D 25/082; F04D 29/24; (Continued)

(56) References Cited

U.S. PATENT DOCUMENTS

| | | | | |
|---|---|---|---|---|
| 6,425,739 | B1 | 7/2002 | Ambler | |
| 10,145,386 | B2 * | 12/2018 | Oh | A47L 5/22 |
| 2007/0122277 | A1 | 5/2007 | Oh et al. | |

(Continued)

FOREIGN PATENT DOCUMENTS

| | | | |
|---|---|---|---|
| CN | 1108138 | C | 5/2003 |
| CN | 101846087 | A | 9/2010 |

(Continued)

OTHER PUBLICATIONS

The first Office Action dated Aug. 30, 2018 in the corresponding CN application No. 201710146107.0.

The Office Action in the corresponding EP application No. 17900765.3.

*Primary Examiner* — Dung Van Nguyen

(57) ABSTRACT

An electric fan and a vacuum cleaner having the same are provided. The electric fan includes: a cover having an open side; an impeller disposed in the cover; a diffuser including a diffuser body and a plurality of vanes, the diffuser body being located at a side of the impeller adjacent to the cover, the plurality of vanes being disposed at an end of the diffuser body adjacent to impeller and spaced apart from one another along an outer circumference of the impeller, an outlet angle of each vane being denoted as β, and β satisfying: 45°≤β≤90°; and a refluxer disposed at an end of the diffuser body away from the impeller. The electric fan reduces flow losses of airflow, and improves work efficiency.

12 Claims, 5 Drawing Sheets

(51) Int. Cl.

| | |
|---|---|
| ***F04D 29/42*** | (2006.01) |
| ***F04D 25/08*** | (2006.01) |
| ***F04D 17/16*** | (2006.01) |
| ***A47L 9/28*** | (2006.01) |
| ***F04D 29/66*** | (2006.01) |

(52) U.S. Cl.
CPC ..... *F04D 17/165* (2013.01); *F04D 25/082* (2013.01); *F04D 29/24* (2013.01); *F04D 29/4253* (2013.01); *F04D 29/444* (2013.01); *F04D 29/667* (2013.01)

(58) Field of Classification Search
CPC ..... F04D 29/4253; F04D 29/444; F04D 29/667
See application file for complete search history.

(56) References Cited

U.S. PATENT DOCUMENTS

| | | | | |
|---|---|---|---|---|
| 2015/0351599 | A1* | 12/2015 | Park | A47L 9/22 417/423.2 |
| 2017/0051755 | A1 | 2/2017 | Liu et al. | |
| 2017/0194833 | A1* | 7/2017 | Bang | H02K 7/14 |
| 2019/0101129 | A1* | 4/2019 | Teramoto | F04D 29/5806 |

FOREIGN PATENT DOCUMENTS

| | | | |
|---|---|---|---|
| DE | 202006020187 | U1 | 1/2008 |
| JP | 2010209770 | A | 9/2010 |
| JP | 2014055568 | A | 3/2014 |
| WO | 9719629 | A | 6/1997 |
| WO | 2016144126 | A | 9/2016 |

* cited by examiner

ELECTRIC FAN AND VACUUM CLEANER HAVING SAME

CROSS-REFERENCE TO RELATED APPLICATION

This application is a continuation of International Application No. PCT/CN2017/083114, filed on May 4, 2017, which claims priority to and benefits of Chinese Patent Application Serial No. 201710146107.0, filed with China National Intellectual Property Administration on Mar. 13, 2017, the entire content of which is incorporated herein by reference.

FIELD

The present disclosure relates to a field of household appliances, more particularly to an electric fan and a vacuum cleaner having the same.

BACKGROUND

Energy efficient and low-noise characteristics of a vacuum cleaner are one of the important trends in its development. The electric fan for the vacuum cleaner is a core functional component of the vacuum cleaner. Therefore, the rational aerodynamic design and structural design of the electric fan can effectively improve the performance of the vacuum cleaner, reduce the energy consumption, and improve the noise level and sound quality of the vacuum cleaner, thereby significantly improving user satisfaction and improving the selling point of vacuum cleaner products. At the same time, the heat dissipation problem of an electric motor is also a problem of the electric fan for the vacuum cleaner. The good heat dissipation can solve the temperature rise problem of the electric fan and prolong the service life of the electric fan.

The airflow velocity at outlet of an impeller of the electric fan is relatively high, and the flow velocity needs to be reduced by diffusing action of the diffuser, so as to reduce the flow losses. In the related art, some electric fans for vacuum cleaners use a vaneless diffuser, because since the vaneless diffuser has insufficient control effect on the airflow, especially in the application scenario of the radial size of the electric fan for the vacuum cleaner and the steering distance of the airflow being relatively small, this is easy to cause the airflow to be turbulent, which reduces the aerodynamic performance of the electric fan. Some other vacuum cleaners use a conventional vaned diffuser, which has a relatively large tangential velocity of the airflow at the outlet of the vane of the conventional vaned diffuser. Therefore, the tangential velocity is not utilized and is mostly wasted, and the flow velocity of the airflow is high, and the flow losses in the flow passage of the above conventional vaned diffuser are large, such that the efficiency of the electric fan is low.

SUMMARY

The present disclosure seeks to solve at least one of the problems existing in the related art. To this end, the present disclosure proposes an electric fan, which has high efficiency.

The present disclosure also proposes a vacuum cleaner having the above-described electric fan.

The electric fan according to embodiments of the present disclosure includes a cover having an open side; an impeller disposed in the cover; a diffuser including a diffuser body and a plurality of vanes, the diffuser body being located at a side of the impeller adjacent to the cover, the plurality of vanes being disposed at an end of the diffuser body adjacent to the impeller and spaced apart from one another along an outer circumference of the impeller, an outlet angle of each vane being denoted as β, and the β satisfying: $45° \le \beta \le 90°$; and a refluxer disposed at an end of the diffuser body away from the impeller.

For the electric fan according to embodiments of the present disclosure, by disposing the vanes of the diffuser at the outer circumference of the impeller and enabling the outlet angle β of each vane to satisfy $45° \le \beta \le 90°$, a tangential flow velocity of airflow is reduced while ensuring aerodynamic performance of the electric fan, such that flow losses of the airflow are reduced, and the efficiency of the electric fan is improved.

According to some embodiments of the present disclosure, each vane deviates from a radial direction of the impeller, and each vane protrudes in a direction away from a datum line, and the datum line is a connection line of an end of the vane adjacent to a center of the impeller and the center of the impeller. Thus, a vane angle progressively increases from inside to outside, and the flow losses of the airflow can be reduced, thereby promoting the performance of the electric fan.

According to some embodiments of the present disclosure, two adjacent vanes define a diffuser flow passage there between, a diffusion degree of the diffuser flow passage is denoted as $\Delta_1$, and the $\Delta_1$ satisfies:

$$\Delta_1 = 2\arctan\frac{\sqrt{A_2/\pi} - \sqrt{A_1/\pi}}{L_1} < 14°,$$

in which $A_1$ is a cross-sectional area at an inlet of the diffuser flow passage, $A_2$ is a cross-sectional area at an outlet of the diffuser flow passage, and $L_1$ is a length of the diffuser flow passage. Thus, the aerodynamic performance of the electric fan is improved.

According to some embodiments of the present disclosure, a cross-sectional area of the diffuser flow passage linearly increases in a direction from the inlet of the diffuser flow passage to the outlet of the diffuser flow passage; or the diffuser flow passage includes a first flow passage and a second flow passage sequentially connected in the direction from the inlet of the diffuser flow passage to the outlet of the diffuser flow passage, a cross-sectional area of the first flow passage linearly increases, and an increase rate of a cross-sectional area of the second flow passage is less than an increase rate of the cross-sectional area of the first flow passage. Thus, flow separation losses of air are reduced, and the performance of the electric fan is improved.

According to some embodiments of the present disclosure, a thickness of an end of each vane adjacent to a center of the impeller is less than a thickness of an end of the vane away from the center of the impeller. Thus, obstruction of the airflow entering the diffuser is reduced, and high-efficiency operation range of the electric fan is broadened.

According to some embodiments of the present disclosure, an end of each vane away from a center of the impeller extends out of an outer circumferential wall of the diffuser body. Thus, the control effect of the vane on the flow of the airflow is enhanced.

According to some embodiments of the present disclosure, the refluxer is disposed at an outer circumference of the diffuser body and is spaced apart from the diffuser body to define a refluxer flow passage. Thus, the refluxer flow passage has a simple structure and good airtightness, thereby further improving the aerodynamic performance of the electric fan.

According to some embodiments of the present disclosure, a diffusion degree of the refluxer flow passage is denoted as $\Delta_2$, and the $\Delta_2$ satisfies:

$$\Delta_2 = 2\arctan\frac{\sqrt{A_4/\pi} - \sqrt{A_3/\pi}}{L_2} < 14°,$$

in which $A_3$ is a cross-sectional area at an inlet of the refluxer flow passage, $A_4$ is a cross-sectional area at an outlet of the refluxer flow passage, and $L_2$ is a length of the refluxer flow passage. Thus, the flow losses of the airflow within the refluxer flow passage are reduced, thereby improving the performance of the electric fan.

According to some embodiments of the present disclosure, a cross-sectional area of the refluxer flow passage remains constant in a direction from the inlet of the refluxer flow passage to the outlet of the refluxer flow passage; or the cross-sectional area of the refluxer flow passage uniformly increases in the direction from the inlet of the refluxer flow passage to the outlet of the refluxer flow passage. Thus, flow separation losses of the airflow within the refluxer flow passage are reduced, and the performance of the electric fan is further improved.

According to some embodiments of the present disclosure, a side of the refluxer away from the impeller is provided with an electric motor, and the outlet of the refluxer flow passage faces the electric motor. Thus, heat dissipation of the electric motor is facilitated, thereby prolonging service life of the electric fan.

According to some embodiments of the present disclosure, the refluxer flow passage obliquely extends along an axial direction of the impeller, from the inlet of the refluxer flow passage to the outlet of the refluxer flow passage and in a direction approaching a central axis of the impeller. Thus, the refluxer flow passage has a simple structure and is easy to implement.

According to some embodiments of the present disclosure, one of the diffuser body and the refluxer is provided with at least one fitting protrusion, and the other one of the diffuser body and the refluxer defines at least one assembling groove fitted with the fitting protrusion. Thus, assembly and disassembly of the diffuser and the refluxer are facilitated.

According to some embodiments of the present disclosure, the cover defines a through air inlet, the air inlet is circular, a diameter of the air inlet is denoted as d, and d satisfies: $d \geq 40$ mm. Thus, air volume of the electric fan can be promoted, and noise of the impeller can be reduced.

The vacuum cleaner according to embodiments of the present disclosure includes an electric fan according to the above embodiments of the present disclosure.

For the vacuum cleaner according to embodiments of the present disclosure, by employing the above electric fan, energy consumption of the vacuum cleaner is reduced, efficiency of the vacuum cleaner is improved, and noise of the vacuum cleaner is reduced, thereby improving sound quality of the vacuum cleaner, and promoting selling points of the vacuum cleaner.

Embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of the present disclosure will become apparent and more readily appreciated from the following descriptions made with reference to the drawings, in which.

REFERENCE NUMERALS

Figure 1:
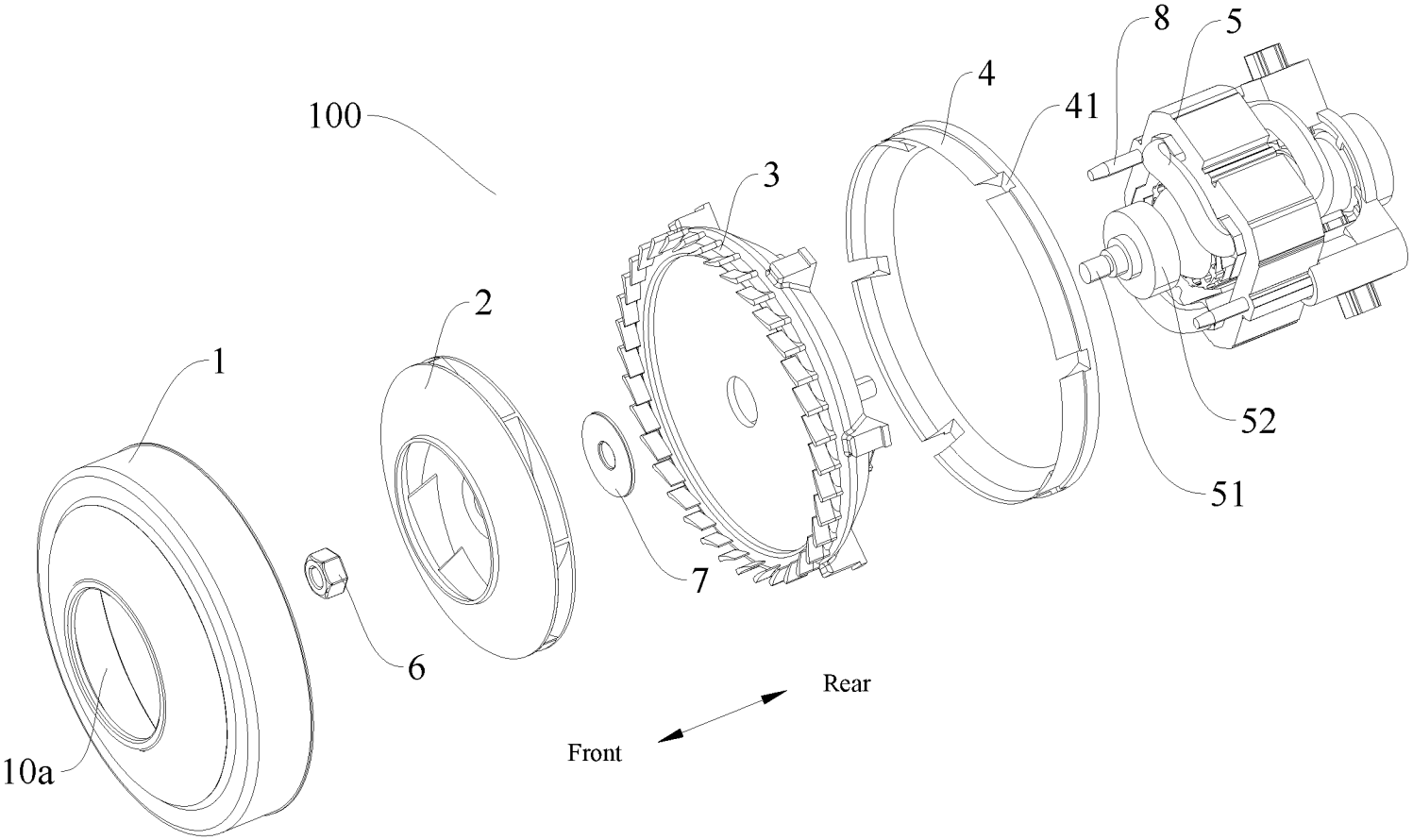
FIG. 1 is an exploded view of an electric fan according to an embodiment of the present disclosure.

100: electric fan;

1: cover; 10*a*: air inlet;

2: impeller;

3: diffuser; 30: diffuser flow passage;

30*a*: inlet of diffuser flow passage; 30*b*: outlet of diffuser flow passage;

31: diffuser body; 311: fitting protrusion; 31*a*: mounting groove;

32: vane; 321: inlet end; 322: outlet end;

4: refluxer; 40: refluxer flow passage; 41: assembling groove;

40*a*: inlet of refluxer flow passage; 40*b*: outlet of refluxer flow passage;

5: electric motor; 51: electric motor shaft; 52: mounting block;

6: shaft head nut; 7: washer; 8: connecting member.

DETAILED DESCRIPTION

Embodiments of the present disclosure will be described in detail and examples of the embodiments will be illustrated in the drawings, where same or similar reference numerals are used to indicate same or similar members or members with same or similar functions. The embodiments described herein with reference to drawings are explanatory, illustrative, and used to generally understand the present disclosure. The embodiments shall not be construed to limit the present disclosure.

In the specification, unless specified or limited otherwise, relative terms such as "central", "length", "thickness", "front", "rear", "inner", "outer", "axial", "radial", "circumferential", "toroidal" as well as derivative thereof should be construed to refer to the orientation as then described or as shown in the drawings under discussion. These relative terms are for convenience of description and may not require that the present disclosure be constructed or operated in a particular orientation. Furthermore, in the description of the present disclosure, the term "a plurality of" means two or more than two, unless specified otherwise.

In the present disclosure, unless specified or limited otherwise, the terms "connected," "coupled" and the like are used broadly, and may be, for example, fixed connections, detachable connections, or integral connections; may also be mechanical or electrical connections; may also be direct connections or indirect connections via intervening structures; may also be inner communications of two elements.

An electric fan 100 according to embodiments of the present disclosure will be described below with reference to FIGS. 1 to 8.

As illustrated in FIGS. 1 to 8, the electric fan 100 according to embodiments of the present disclosure includes a cover 1, an impeller 2, a diffuser 3 and a refluxer 4.

The cover 1 has an open side. The impeller 2 is disposed in the cover 1. The diffuser 3 includes a diffuser body 31 and a plurality of vanes 32. The diffuser body 31 is located at a side of the impeller 2 adjacent to the cover 1. The plurality of vanes 32 are disposed at an end of the diffuser body 31 adjacent to impeller 2, and the plurality of vanes are spaced apart from one another along an outer circumference of the impeller 2. An outlet angle of each vane 32 is denoted as β, and β satisfies: 45°≤β≤90°. The refluxer 4 is disposed at an end of the diffuser body 31 away from the impeller 2. It should be noted herein that, the direction "outside" is a direction away from a central axis of the electric fan 100, and an opposite direction thereof is defined as "inside".

Figure 5:
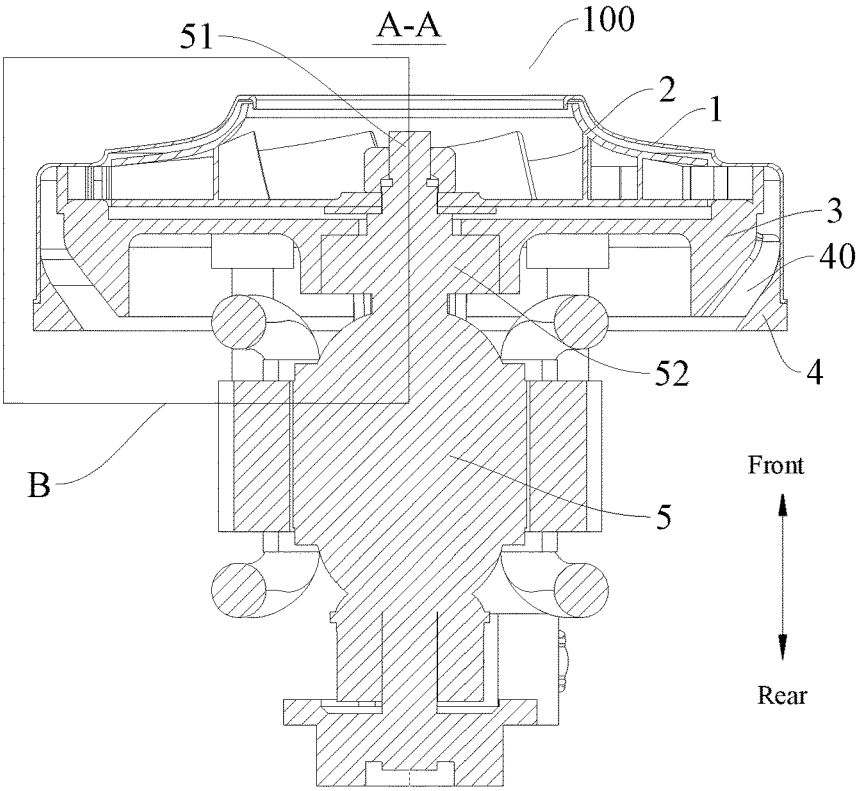
FIG. 5 is a sectional view taken along line A-A in FIG. 4.

For example, as illustrated in FIGS. 1-3 and 8, a rear side of the cover 1 is completely opened, and both the impeller 2 and diffuser 3 are disposed in the cover 1. The diffuser body 31 is located at a rear side of the impeller 2, the plurality of vanes are disposed at a front end of the diffuser body 31, and the refluxer 4 is disposed at a rear end of the diffuser body 31. Since the outlet angle β of each vane 32 of the diffuser 3 satisfies 45°≤β≤90°, the outlet angle β of the vane 32 is relatively large, the vane can control flow of airflow to ensure the aerodynamic performance of the electric fan 100, and a tangential velocity component of the airflow diffused by the diffuser 3 is reduced to reduce the flow velocity of the airflow, thereby reducing the resistance losses of the airflow, and promoting the performance of the electric fan 100. It should be noted herein that, "the outlet angle β of the vane 32" may be understood as an included angle between a tangent to a mean camber line of the vane 32 at the outlet along an airflow direction and a circumferential direction, and the "mean camber line" refers to a middle line of a section of the vane 32 along a streamline direction thereof. It could be understood that, the vane 32 and the impeller 2 may be located in the same cross section of the electric fan 100, in which case the vane 32 and the impeller 2 are radially opposite to each other, as illustrated in FIG. 5; certainly, the vane 32 and the impeller 2 may also be located in different cross sections, in which case the vane 32 and the impeller 2 are axially staggered to each other.

Specifically, when the electric fan 100 is in operation, the impeller 2 rotates at a high speed, an external air outside the electric fan 100 may enter the cover 1 through an air inlet 10*a* in a front side of the cover 1, and is rotated with rotation of the impeller 2, such that the air obtains a certain amount of energy; the air is rotated to an outer edge of the impeller 2 and flows to the diffuser 3 under a centrifugal force of inertia during the rotation of the air; the diffuser 3 converts kinetic energy of the air into static pressure energy; and then the refluxer 4 functions to guide and rectify to some extent the air out of the diffuser 3. In the above-described process, the outlet angle β of each vane 32 of the diffuser 3 satisfies 45°≤β≤90°, and the outlet angle β is relatively large, such that the vane 32 is curved to a radial direction of the diffuser 3 at the outlet of the vane, the tangential velocity component of the airflow diffused by the diffuser 3 is reduced, the flow velocity of the airflow is reduced, and more kinetic energy is converted into static pressure energy, thereby promoting a diffusion coefficient of the diffuser 3 (which may be understood as a ratio of air pressure at the outlet of the diffuser 3 to air pressure at the inlet of the diffuser 3); moreover, energy losses of the air flowing within the diffuser 3 is reduced, and the resistance losses of the airflow is reduced, thereby further improving the efficiency of the electric fan 100 and promoting the performance of the electric fan 100.

For the electric fan 100 according to embodiments of the present disclosure, by disposing the vanes 32 of the diffuser 3 at the outer circumference of the impeller 2 and enabling the outlet angle β of each vane 32 to satisfy 45°≤β≤90°, a tangential flow velocity of the airflow is reduced while ensuring aerodynamic performance of the electric fan 100, such that flow losses of the airflow are reduced, the efficiency of the electric fan 100 is improved, and the performance of the electric fan 100 is promoted.

Figure 3:
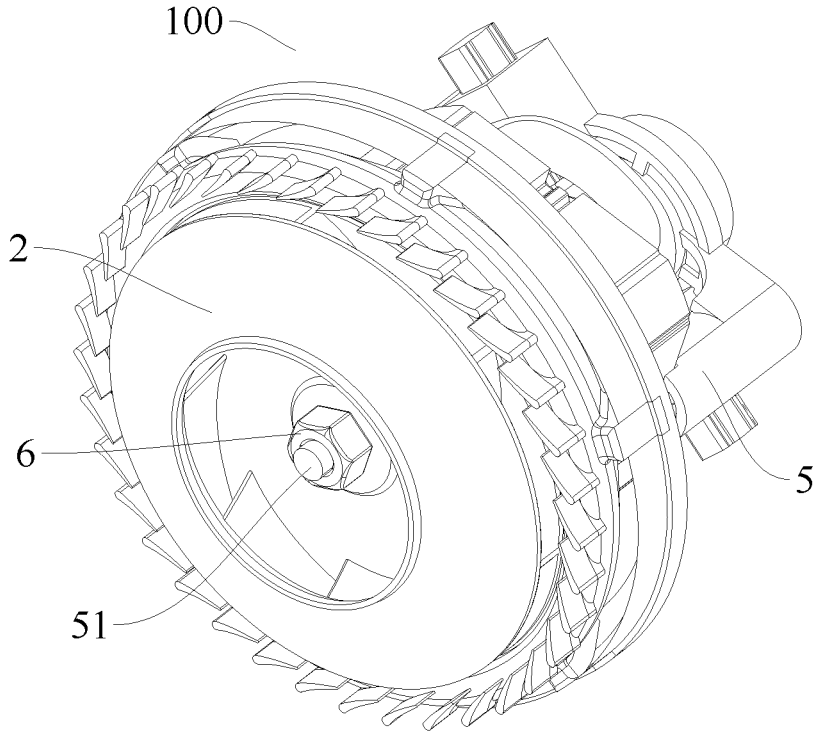
FIG. 3 is another schematic view of the electric fan shown in FIG. 2, without showing a cover.
Figure 4:
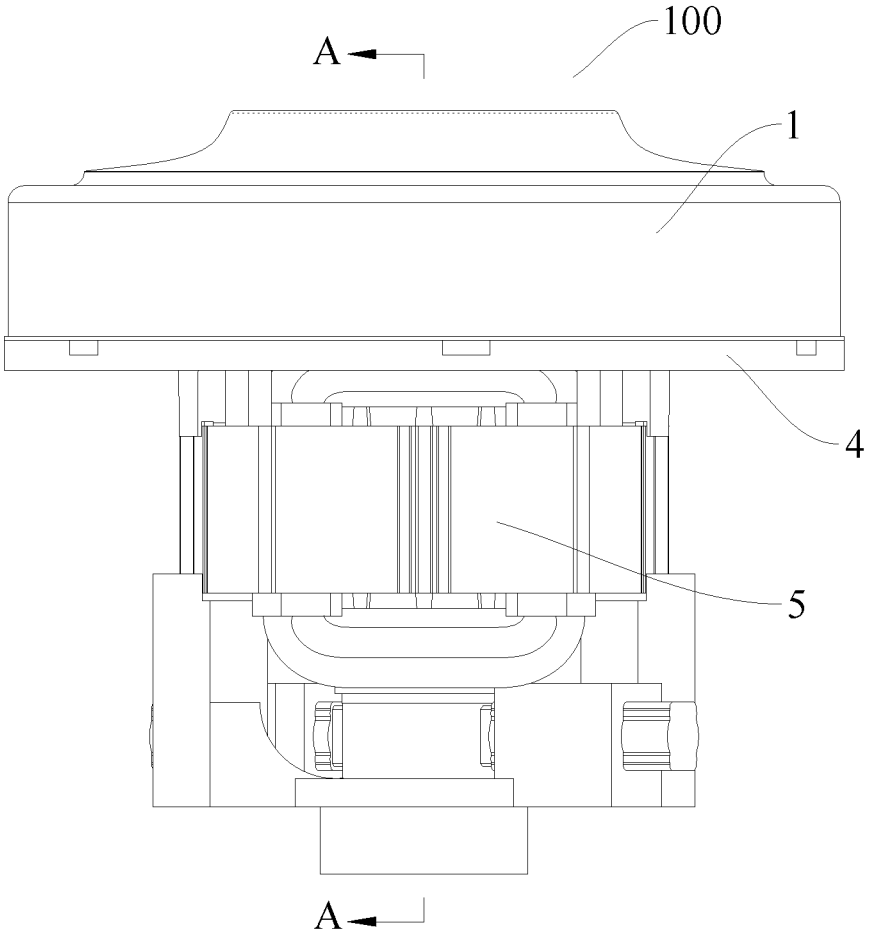
FIG. 4 is a front view of the electric fan shown in FIG. 1.
Figure 8:
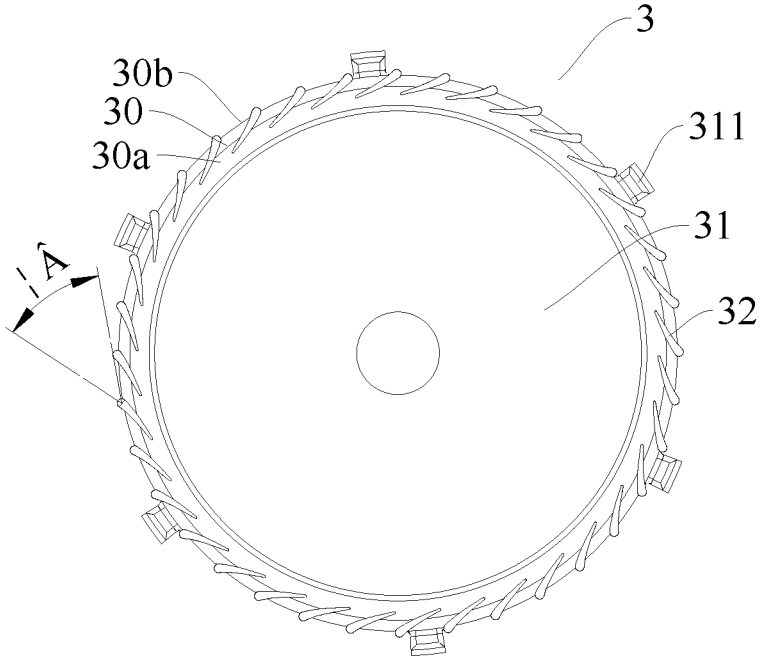
FIG. 8 is a front view of a diffuser in FIG. 1.

In one embodiment of the present disclosure, each vane 32 deviates from a radial direction of the impeller 2, and each vane 32 protrudes in a direction away from a datum line, and the datum line is a connection line of an end of the vane 32 adjacent to a center of the impeller 2 and the center of the impeller 2. For example, as illustrated in FIGS. 1, 3 and 8, an extending direction of each vane 32 deviates from the radial direction of the impeller 2, and each vane 32 protrudes in a direction away from a datum line from inside to outside, the datum line is a connection line of an inlet end 321 of the vane 32 (i.e. the end of the vane 32 adjacent to the center of the impeller 2) and the center of the impeller 2. In this case, an inlet angle of the vane 32 (an included angle between a tangent to the mean camber line of the vane 32 at the inlet along the airflow direction and the circumferential direction) is smaller than the outlet angle β of the vane 32, and a vane angle (an included angle between a tangent to the mean camber line of the vane 32 along the airflow direction and the circumferential direction) increases from inside to outside, such that the tangential flow velocity of the airflow decreases gradually, the flow velocity of the airflow is reduced, and the flow losses of the airflow are reduced, thereby promoting the performance of the electric fan 100.

In one embodiment of the present disclosure, two adjacent vanes 32 define a diffuser flow passage 30 there between, a diffusion degree of the diffuser flow passage 30 is denoted as $\Delta_1$, and the $\Delta_1$ satisfies:

$$\Delta_1 = 2\arctan\frac{\sqrt{A_2/\pi} - \sqrt{A_1/\pi}}{L_1} < 14°,$$

in which $A_1$ is a cross-sectional area at an inlet 30*a* of the diffuser flow passage, $A_2$ is a cross-sectional area at an outlet 30*b* of the diffuser flow passage, and $L_1$ is a length of the diffuser flow passage 30. For example, as illustrated in FIGS. 5 to 8, a front end of the vane 32 of the diffuser 3 may abuts against an inner wall surface of the cover 1, two adjacent vanes 32 and the cover 1 collectively define the diffuser flow passage 30, the diffusion degree $\Delta_1$ of the diffuser flow passage 30 satisfies $$\Delta_1 = 2\arctan\frac{\sqrt{A_2/\pi} - \sqrt{A_1/\pi}}{L_1} < 14°,$$

such that by setting the diffusion degree $\Delta_1$ of the diffuser flow passage 30 to satisfy to be less than 14°, the diffuser flow passage 30 between the two adjacent vanes 32 has sufficient control effect on the flow of the airflow under the premise of ensuring the diffusion coefficient of the diffuser 3, so as to avoid turbulent flow of the airflow resulting from insufficient control of the diffuser 3 on the flow of the airflow, thereby promoting the aerodynamic performance of the electric fan 100. It should be noted herein that, the "length of the diffuser flow passage 30" is a length of a central axis of the diffuser flow passage 30.

In one embodiment, a cross-sectional area of the diffuser flow passage 30 linearly increases in a direction from the inlet 30*a* of the diffuser flow passage to the outlet 30*b* of the diffuser flow passage; or the diffuser flow passage 30 includes a first flow passage and a second flow passage (not shown) sequentially connected in the direction from the inlet 30*a* of the diffuser flow passage to the outlet 30*b* of the diffuser flow passage, a cross-sectional area of the first flow passage linearly increases, and an increase rate of a cross-sectional area of the second flow passage is less than an increase rate of the cross-sectional area of the first flow passage. That is to say, from the inlet 30*a* of the diffuser flow passage through the diffuser flow passage 30 to the outlet 30*b* of the diffuser flow passage, a cross-sectional area of the diffuser flow passage 30 linearly increases from $A_1$ to $A_2$, in which case the cross-sectional area of the diffuser flow passage 30 is gradually varying; or the cross-sectional area of the first flow passage linearly increases, and the increase rate of the cross-sectional area of the second flow passage is less than the increase rate of the cross-sectional area of the first flow passage, in which case the cross-sectional area of the second flow passage may linearly increase or curvilinearly increase, which is not limited. Thus, by setting the cross-sectional area of the diffuser flow passage 30 to increase linearly, a flow separation phenomenon of the airflow within the diffuser flow passage 30 can be alleviated, such that flow separation losses of the airflow within the diffuser flow passage 30 are reduced, and energy losses of the air flowing within the diffuser 3 are further reduced, thereby promoting the performance of the electric fan 100. By setting the cross-sectional area of the first flow passage of the diffuser flow passage 30 to increase linearly, and setting the increase rate of the cross-sectional area of the second flow passage thereof to be less than the increase rate of the cross-sectional area of the first flow passage, the flow separation phenomenon of the airflow within the second flow passage can be further alleviated, thereby further promoting the performance of the electric fan 100.

In one optional embodiment of the present disclosure, a thickness of an end of each vane 32 adjacent to the center of the impeller 2 is less than a thickness of an end thereof away from the center of the impeller 2. For example, as illustrated in FIGS. 1, 3, 7 and 8, when the airflow flows out of the impeller 2 and into the diffuser 3, the airflow flows from the inlet end 321 of the vane 32 to the outlet end 322 of the vane 32 (i.e. the end of the vane 32 away from the center of the impeller 2) along the extending direction of the vane 32. The thickness of the inlet end 321 of the vane 32 is less than the thickness of the outlet end 322 of the vane 32, and the thickness of the inlet end 321 of the vane 32 is thinner, such that it is convenient for the airflow to smoothly flow into the diffuser 3 via the inlet end 321 of the vane 32, obstruction of the airflow entering the diffuser 3 is reduced, and energy consumption of the airflow is reduced, thereby broadening the high-efficiency operation range of the electric fan 100, improving capacity of the electric fan 100 adapting work conditions, and promoting applicability of the electric fan 100. It should be noted herein that, the "thickness" refers to a length of the vane 32 in a normal direction of the mean camber line thereof.

Further, as illustrated in FIG. 8, the thickness of the vane 32 is optionally increased uniformly from the inlet end 321 of the vane 32 to the outlet end 322 of the vane 32 along the extending direction of the vane 32, such that the cross-sectional area of the diffuser flow passage 30 defined between two adjacent vanes 32 varies uniformly, thereby further reducing the flow separation losses of the airflow.

In one embodiment of the present disclosure, the end of each vane 32 away from the center of the impeller 2 extends out of an outer circumferential wall of the diffuser body 31. For example, as illustrated in FIGS. 1, 3, 7 and 8, the diffuser body 31 may be a substantially ring-shaped structure, the plurality of vanes 32 are disposed at an outer edge of the diffuser body 31, and the outlet end 322 of each vane 32 extends outwards and beyond the outer circumferential wall of the diffuser body 31, such that the length of the vane 32 is appropriately lengthened, and the control effect on the flow of the airflow by the vane 32 is enhanced. It should be noted herein that, the "length" refers to a length of the mean camber line of the vane 32.

In some embodiments of the present disclosure, the refluxer 4 is disposed at the outer circumference of the diffuser body 31 and the refluxer 4 is spaced apart from the diffuser body 31 to define a refluxer flow passage 40. For example, as illustrated in FIGS. 1 and 5-7, the refluxer 4 may be a ring-shaped structure, and the refluxer 4 is coaxially disposed outside the diffuser body 31, such that the refluxer flow passage 40 is formed as a substantially ring-shaped structure, which has a simple and compact structure and is easy to implement. Moreover, a spacing between the refluxer 4 and the diffuser body 31 forms the refluxer flow passage 40, such that the refluxer flow passage 40 forms an enclosed flow passage, and presence of a sudden expansion portion of the refluxer flow passage 40 is avoided, thereby further promoting the aerodynamic performance of the electric fan 100.

Figure 6:
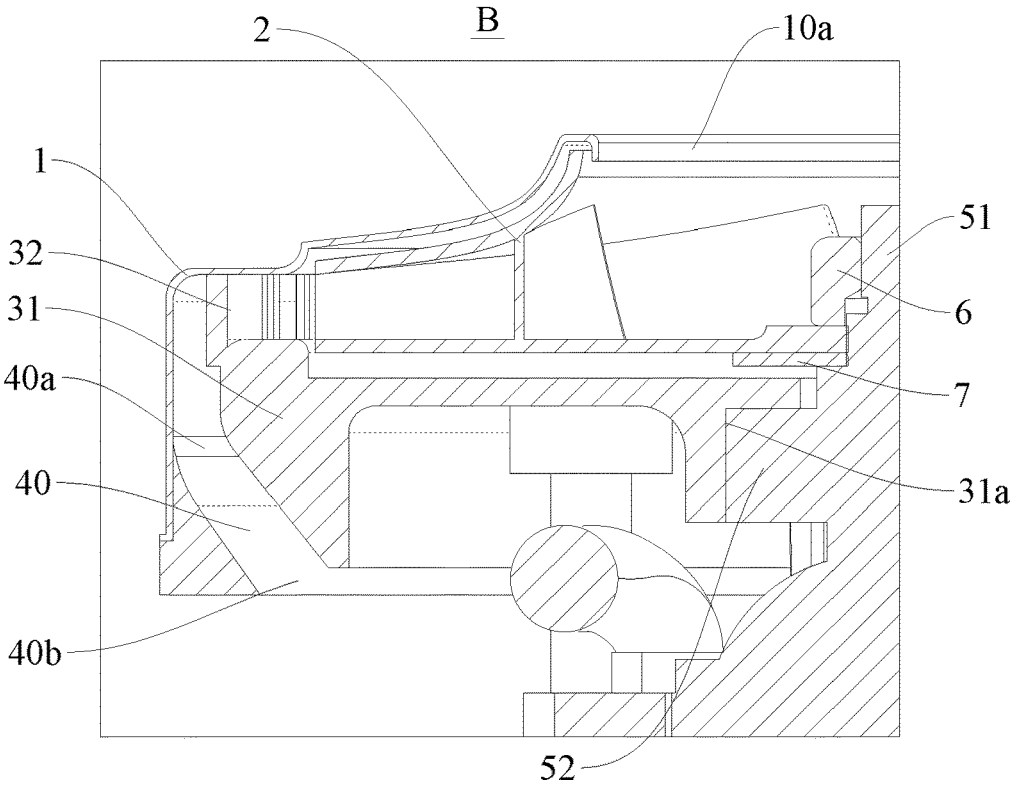
FIG. 6 is an enlarged view of portion B boxed in FIG. 5.
Figure 7:
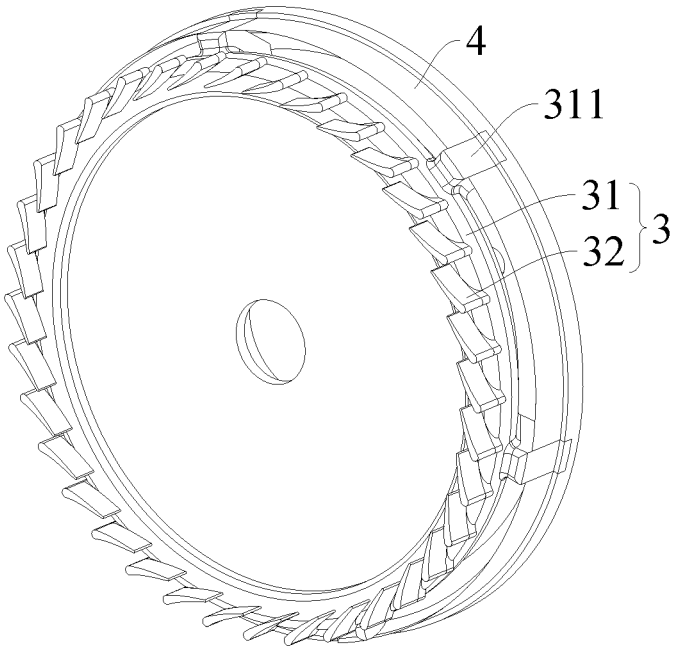
FIG. 7 is an assembly view of a diffuser and a refluxer shown in FIG. 1.

In some embodiments of the present disclosure, a diffusion degree of the refluxer flow passage 40 is denoted as $\Delta_2$, and the $\Delta_2$ satisfies:

$$\Delta_2 = 2\arctan\frac{\sqrt{A_4/\pi} - \sqrt{A_3/\pi}}{L_2} < 14°,$$

in which $A_3$ is a cross-sectional area at an inlet 40*a* of the refluxer flow passage, $A_4$ is a cross-sectional area at an outlet 40*b* of the refluxer flow passage, and $L_2$ is a length of the refluxer flow passage 40. For example, as illustrated in FIGS. 5 and 6, a front end of the refluxer 4 and the diffuser body 31 define the inlet 40*a* of the refluxer flow passage there between, while a rear end of the refluxer 4 and the diffuser body 31 define the outlet 40*b* of the refluxer flow passage there between. By setting the diffusion degree $\Delta_2$ of the refluxer flow passage 40 to satisfy $$\Delta_2 = 2\arctan\frac{\sqrt{A_4/\pi} - \sqrt{A_3/\pi}}{L_2} < 14°,$$

relatively large partial resistance losses and frictional resistance losses of the airflow due to the refluxer flow passage 40 being a contracted flow passage can be avoided, and the flow losses of the airflow within the refluxer flow passage 40 can be reduced, thereby facilitating decrease of the energy consumption of the airflow and promoting the performance of the electric fan 100.

In one embodiment, the cross-sectional area of the refluxer flow passage 40 may remain constant in a direction from the inlet 40*a* of the refluxer flow passage to the outlet 40*b* of the refluxer flow passage; or the cross-sectional area of the refluxer flow passage 40 may also increase uniformly in the direction from the inlet 40*a* of the refluxer flow passage to the outlet 40*b* of the refluxer flow passage. That is to say, $A_3 \leq A_4$, i.e. the cross-sectional area of the refluxer flow passage 40 may always be $A_3$ (in this case, $A_4=A_3$) from the inlet 40*a* of the refluxer flow passage through the refluxer flow passage 40 to the outlet 40*b* of the refluxer flow passage, or the cross-sectional area of the refluxer flow passage 40 uniformly increases from $A_3$ to $A_4$ (in this case, $A_3<A_4$). Thus, by setting the cross-sectional area of the refluxer flow passage 40 to remain constant or increase uniformly, a flow separation phenomenon of the airflow within the refluxer flow passage 40 can be alleviated, such that flow separation losses of the airflow within the refluxer flow passage 40 are reduced, and energy losses of the air flowing within the refluxer 4 is further reduced, thereby promoting the performance of the electric fan 100.

Further, a side of the refluxer 4 away from the impeller 2 is provided with an electric motor 5, and the outlet 40*b* of the refluxer flow passage faces the electric motor 5. For example, as illustrated in FIGS. 5 and 6, the electric motor 5 is disposed at a rear side of the refluxer 4, and the outlet 40*b* of the refluxer flow passage faces the electric motor 5, such that the airflow out of the refluxer 4 can dissipate heat of the electric motor 5, operation condition of the electric motor 5 is improved, thereby solving temperature rise problem of the electric fan 100 and prolonging service life of the electric fan 100. Moreover, the outlet 40*b* of the refluxer flow passage is a substantially ring-shaped outlet, such that the heat of the electric motor 5 can be dissipated more evenly. Meanwhile, the outlet 40*b* of the refluxer flow passage is disposed outside the electric motor 5, such that relatively large obstruction to the airflow generated by the components within the electric motor 5, such as stator and rotor structure, coil and carbon brush, etc., due to heat dissipation of the electric motor 5 which may require the airflow to flow into an interior of the electric motor 5, can be avoided. This obstruction will affect the flow of the airflow within an upstream flow passage such as the refluxer flow passage 40. In other words, the above arrangement way of the outlet 40*b* of the refluxer flow passage reduces the flow losses of the airflow, thereby promoting the efficiency of the electric fan 100.

In one embodiment, as illustrated in FIGS. 5 and 6, the refluxer flow passage 40 extends obliquely along an axial direction of the impeller 2, from the inlet 40*a* of the refluxer flow passage to the outlet 40*b* of the refluxer flow passage and in a direction approaching a central axis of the impeller 2. That is to say, the refluxer flow passage 40 extends obliquely from the inlet 40*a* of the refluxer flow passage to the outlet 40*b* of the refluxer flow passage along the axial direction of the impeller 2 from outside to inside, such that the outlet 40*b* of the refluxer flow passage faces the electric motor 5 to dissipate the heat of the electric motor 5, and a structure of the refluxer flow passage 40 is further simplified.

In some embodiments of the present disclosure, one of the diffuser body 31 and the refluxer 4 is provided with at least one fitting protrusion 311, and the other one of the diffuser body 31 and the refluxer 4 defines at least one assembling groove 41 fitted with the fitting protrusion 311. Thus, through the fitting between the fitting protrusion 311 and the assembling groove 41, disassembly and assembly of the diffuser 3 and the refluxer 4 are facilitated, and the structure of the diffuser 3 and the refluxer 4 after assembly is more compact.

For example, in examples illustrated in FIGS. 1-4, 7 and 8, six fitting protrusions 311 are provided on the outer circumferential wall of the diffuser body 31, and the six fitting protrusions 311 may be distributed at even intervals along a circumferential direction of the diffuser body 31, each fitting protrusion 311 extends rearwards from the outer circumferential wall of the diffuser body 31 along the axial direction of the electric fan 100. The refluxer 4 is correspondingly provided with six assembling grooves 41, each assembling groove 41 is formed by recessing a partial edge of the refluxer 4 rearwards along the axial direction of the electric fan 100. The six fitting protrusions 311 are fitted in the six assembling grooves 41 in one-to-one correspondence, thereby facilitating the disassembly and assembly between the diffuser 3 and the refluxer 4. It could be understood that, the number of the fitting protrusions 311 and the assembling grooves 41, and their arrangement way can be set according to actual requirements, so as to better satisfy the actual application.

Figure 2:
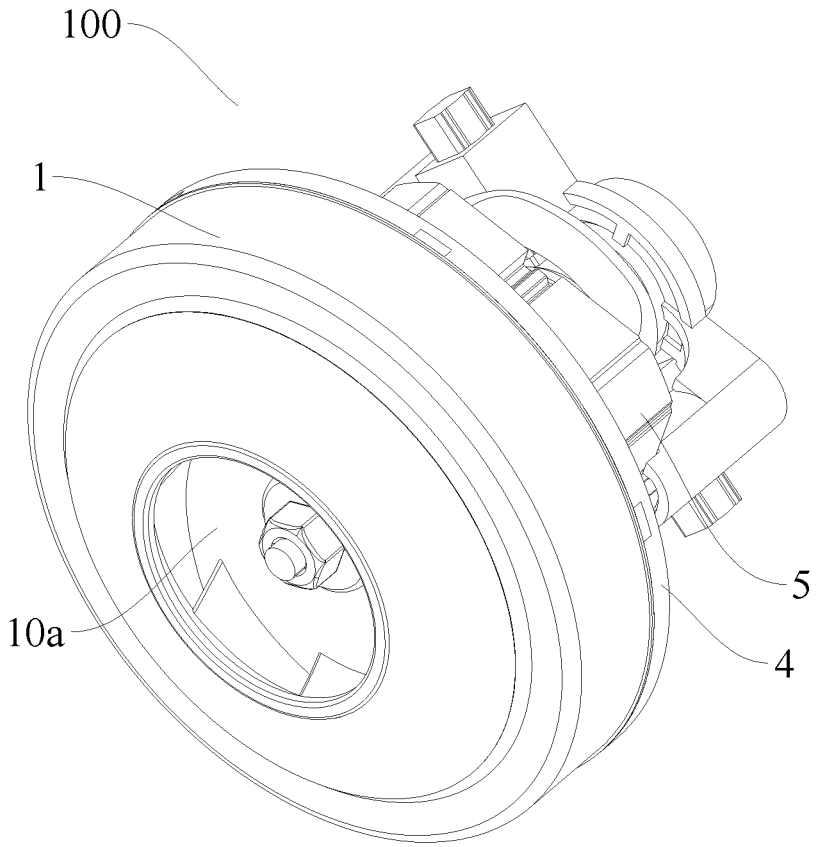
FIG. 2 is an assembly view of the electric fan shown in FIG. 1.

In one embodiment of the present disclosure, the cover 1 defines a through air inlet 10*a*, the air inlet 10*a* is circular, a diameter of the air inlet 10*a* is denoted as d, and d satisfies: $d \geq 40$ mm. For example, as illustrated in FIGS. 1 and 2, the air inlet 10*a* is defined in the front side of the cover 1. When the electric fan 100 is in operation, the impeller 2 rotates, such that a certain amount of negative pressure is produced at the air inlet 10*a*, and the external air flows into the electric fan 100 through the air inlet 10*a*. By setting the diameter of the air inlet 10*a* to be denoted as d and satisfy $d \geq 40$ mm, air volume of the electric fan 100 can be promoted at the same rotating speed of the impeller 2; or in the case where a certain amount of air volume may be required, the rotating speed of the impeller 2 can be reduced, so as to reduce noise of the impeller 2.

The electric fan 100 according to one embodiment of the present disclosure will be described in detail below with reference to FIGS. 1 to 8.

As illustrated in FIGS. 1 to 8, the electric fan 100 includes the cover 1, the impeller 2, the diffuser 3, the refluxer 4, and the electric motor 5 that are arranged from front to rear. The front side of the cover 1 defines a through air inlet 10*a*, the air inlet 10*a* is a circular opening, and the diameter d of the air inlet 10*a* $\geq 40$ mm. The rear side of the cover 1 is completely open, and the cover 1 and the refluxer 4 can be connected through an interference fit, such that the cover 1 and the refluxer 4 define a cavity there between, and the impeller 2 and the diffuser 3 are both disposed in the above cavity. The outer circumferential wall of the diffuser body 31 is provided with six fitting protrusions 311 at even intervals along the circumferential direction of the diffuser body 31, and the refluxer 4 is correspondingly provided with six assembling grooves 41, such that the diffuser 3 is connected to the refluxer 4 through the fitting between the fitting protrusions 311 and the assembling grooves 41. Furthermore, the electric motor 5 has an electric motor shaft 51. The electric motor shaft 51 penetrates the diffuser 3 and the impeller 2 in turn from rear to front, and a front end of the electric motor shaft 51 is provided with a shaft head nut 6, so as to mount the impeller 2 onto the electric motor shaft 51. A rear end of the electric motor shaft 51 is provided with a mounting block 52. The mounting block 52 is placed in a mounting groove 31*a* in the rear end of the diffuser 3, and the electric motor 5 is fixedly connected to the diffuser 3 through a connecting member 8. For example, the connecting member 8 may optionally be a screw, and so on. Additionally, the impeller 2 and a shaft shoulder of the electric motor shaft 51 may be provided with a washer 7 there between.

As illustrated in FIGS. 1 to 8, the diffuser 3 includes the diffuser body 31 and the plurality of vanes 32. The diffuser body 31 may be a substantially ring-shaped structure, the plurality of vanes 32 are disposed at the front end of the diffuser body 31, the plurality of vanes 32 are spaced apart evenly from one another along the outer circumference of the impeller 2, and the plurality of vanes 32 and the impeller 2 are located in the same cross section of the electric fan 100, in which case the vane 32 is radially opposite to the impeller 2. Each vane 32 extends from inside to outside, and beyond the outer edge of the diffuser body 31. The vane angle of each vane 32 increases from inside to outside, and the outlet angle β of the vane 32 satisfies 45°≤β≤90°. The thickness of each vane 32 increases uniformly from inside to outside. Meanwhile, the front end of each vane 32 abuts against the inner wall surface of the cover 1, such that two adjacent vanes 32 and the cover 1 collectively define the diffuser flow passage 30 there among. The diffusion degree $\Delta_1$ of the diffuser flow passage 30 satisfies $$\Delta_1 < 14^\circ \left( \Delta_1 = 2\arctan\frac{\sqrt{A_2/\pi} - \sqrt{A_1/\pi}}{L_1}, \right.$$

in which, $A_1$ is the cross-sectional area at the inlet 30*a* of the diffuser flow passage, $A_2$ is the cross-sectional area at the outlet 30*b* of the diffuser flow passage, and $L_1$ is the length of the diffuser flow passage 30), and the cross-sectional area of the diffuser flow passage 30 increases linearly from $A_1$ to $A_2$, from the inlet 30*a* of the diffuser flow passage through the diffuser flow passage 30 to the outlet 30*b* of the diffuser flow passage.

As illustrated in FIGS. 1 to 8, the refluxer 4 may be ring-shaped structure, and the refluxer 4 is coaxially disposed outside the diffuser body 31 at an interval, such that the refluxer 4 and the diffuser body 31 define the refluxer flow passage 40 there between. The diffusion degree $\Delta_2$ of the refluxer flow passage 40 is <14°

$$\left( \Delta_2 = 2\arctan\frac{\sqrt{A_4/\pi} - \sqrt{A_3/\pi}}{L_2}, \right.$$

in which, $A_3$ is the cross-sectional area at the inlet 40*a* of the refluxer flow passage, $A_4$ is the cross-sectional area at the outlet 40*b* of the refluxer flow passage, and the $L_2$ is the length of the refluxer flow passage 40), and the cross-sectional area of the refluxer flow passage 40 increases uniformly from $A_3$ to $A_4$ from the inlet 40*a* of the refluxer flow passage through the refluxer flow passage 40 to the outlet 40*b* of the refluxer flow passage. The refluxer flow passage 40 extends obliquely from the inlet 40*a* of the refluxer flow passage to the outlet 40*b* of the refluxer flow passage along a front-and-rear direction from outside to inside, such that the outlet 40*b* of the refluxer flow passage faces the electric motor 5 to dissipate the heat of the electric motor 5.

When the electric fan 100 is in operation, the electric motor shaft 51 drives the impeller 2 to rotate at a high speed, the external air enters the impeller 2 through the air inlet 10*a*, and is rotated with rotation of the impeller 2, such that the air obtains a certain amount of energy; the air is rotated to the outer edge of the impeller 2 and flows into the diffuser flow passage 30 under the centrifugal force of inertia during the rotation of the air; the diffuser 3 converts kinetic energy of the air into static pressure energy due to linear increase of the cross-sectional area of the diffuser flow passage 30; and then the refluxer 40 guides and diffuses the air out of the diffuser 3, and the air flows out of the refluxer flow passage 40 and dissipates the heat of the electric motor 5.

For the electric fan 100 according to the embodiments of the present disclosure, both of the diffuser flow passage 30 and the refluxer flow passage 40 can reduce the flow losses of the airflow, so as to reduce the energy consumption, promote the performance of the electric fan 100, and improve the applicability of the electric fan 100; meanwhile, the airflow can perform good heat dissipation of the electric motor 5, prolonging the service life of the electric fan 100; moreover, the air volume of the electric fan 100 is relatively large at the same rotating speed of the impeller 2, or the noise of the electric fan 100 is relatively low in the case of a certain amount of air volume.

The vacuum cleaner (not shown) according to embodiments of the present disclosure includes an electric fan 100 according to the above embodiments of the present disclosure.

In one embodiment, a vacuum cleaner defines a suction port and a discharge port, the electric fan 100 is mounted in the vacuum cleaner, the suction port of the vacuum cleaner is in communication with the air inlet 10*a* of the electric fan 100, and the vacuum cleaner is internally provided with a filter device and a dust collecting device. When the vacuum cleaner is in operation, the electric fan 100 operates, such that a certain amount of negative pressure is produced at the suction port, the surrounding dust laden air is sucked into the vacuum cleaner through the suction port, and filtered by the filter device, such that the foreign matter such as the dust is filtered and collected in the dust collecting device. The clean air then flows into the electric fan 100 through the air inlet 10*a*, and finally discharged though the discharge port of the vacuum cleaner.

For the vacuum cleaner according to embodiments of the present disclosure, by employing the above electric fan 100, energy consumption of the vacuum cleaner is reduced, efficiency of the vacuum cleaner is improved, and noise of the vacuum cleaner is reduced, thereby improving sound quality of the vacuum cleaner, and promoting selling points of the vacuum cleaner.

Reference throughout this specification to "an embodiment," "some embodiments," "an illustrative embodiment," "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples.

What is claimed is:

1. An electric fan, comprising:

a cover having an open side;

an impeller disposed in the cover;

a diffuser comprising a diffuser body and a plurality of vanes, the diffuser body being located at a side of the impeller adjacent to the cover, the plurality of vanes being disposed at an end of the diffuser body adjacent to the impeller and spaced apart from one another along an outer circumference of the impeller, an outlet angle of each vane being denoted as β, and the β satisfying: 45°≤β≤90'; and a refluxer disposed at an end of the diffuser body away from the impeller;

wherein the refluxer is disposed at an outer circumference of the diffuser body and is spaced apart from the diffuser body to define a refluxer flow passage;

wherein a cross-sectional area of the refluxer flow passage remains constant in a direction from the inlet of the refluxer flow passage to the outlet of the refluxer flow passage; or the cross-sectional area of the refluxer flow passage uniformly increases in the direction from the inlet of the refluxer flow passage to the outlet of the refluxer flow passage.

2. The electric fan according to claim 1, wherein each vane deviates from a radial direction of the impeller, and each vane protrudes in a direction away from a datum line from inside to outside, and the datum line is a connection line of an end of the vane adjacent to a center of the impeller and the center of the impeller.

3. The electric fan according to claim 1, wherein two adjacent vanes define a diffuser flow passage there between, a diffusion degree of the diffuser flow passage is denoted as $\Delta_1$, and the $\Delta_1$ satisfies:

$$\Delta_1 = 2\arctan\frac{\sqrt{A_2/\pi} - \sqrt{A_1/\pi}}{L_1} < 14°,$$

in which $A_1$ is a cross-sectional area at an inlet of the diffuser flow passage, $A_2$ is a cross-sectional area at an outlet of the diffuser flow passage, and $L_1$ is a length of the diffuser flow passage.

4. The electric fan according to claim 3, wherein a cross-sectional area of the diffuser flow passage linearly increases in a direction from the inlet of the diffuser flow passage to the outlet of the diffuser flow passage; or the diffuser flow passage comprises a first flow passage and a second flow passage sequentially connected in the direction from the inlet of the diffuser flow passage to the outlet of the diffuser flow passage, a cross-sectional area of the first flow passage linearly increases, and an increase rate of a cross-sectional area of the second flow passage is less than an increase rate of the cross-sectional area of the first flow passage.

5. The electric fan according to claim 1, wherein a thickness of an end of each vane adjacent to a center of the impeller is less than a thickness of an end of the vane away from the center of the impeller.

6. The electric fan according to claim 1, wherein an end of each vane away from a center of the impeller extends out of an outer circumferential wall of the diffuser body.

7. The electric fan according to claim 1, wherein a diffusion degree of the refluxer flow passage is denoted as $\Delta_2$, and the $\Delta_2$ satisfies:

$$\Delta_2 = 2\arctan\frac{\sqrt{A_4/\pi} - \sqrt{A_3/\pi}}{L_2} < 14°,$$

in which $A_3$ is a cross-sectional area at an inlet of the refluxer flow passage, $A_4$ is a cross-sectional area at an outlet of the refluxer flow passage, and $L_2$ is a length of the refluxer flow passage.

8. The electric fan according to claim 1, wherein a side of the refluxer away from the impeller is provided with an electric motor, and the outlet of the refluxer flow passage faces the electric motor.

9. The electric fan according to claim 8, wherein the refluxer flow passage obliquely extends along an axial direction of the impeller, from the inlet of the refluxer flow passage to the outlet of the refluxer flow passage and in a direction approaching a central axis of the impeller.

10. The electric fan according to claim 1, wherein one of the diffuser body and the refluxer is provided with at least one fitting protrusion, and the other one of the diffuser body and the refluxer defines at least one assembling groove fitted with the fitting protrusion.

11. The electric fan according to claim 1, wherein the cover defines a through air inlet, the air inlet is circular, a diameter of the air inlet is denoted as d, and d satisfies: d≥40 mm.

12. A vacuum cleaner comprising:

an electric fan, comprising:

a cover having an open side;

an impeller disposed in the cover;

a diffuser comprising a diffuser body and a plurality of vanes, the diffuser body being located at a side of the impeller adjacent to the cover, the plurality of vanes being disposed at an end of the diffuser body adjacent to the impeller and spaced apart from one another along an outer circumference of the impeller, an outlet angle of each vane being denoted as β, and the β satisfying: 45°≤β≤90'; and a refluxer disposed at an end of the diffuser body away from the impeller;

wherein the refluxer is disposed at an outer circumference of the diffuser body and is spaced apart from the diffuser body to define a refluxer flow passage;

wherein a cross-sectional area of the refluxer flow passage remains constant in a direction from the inlet of the refluxer flow passage to the outlet of the refluxer flow passage; or the cross-sectional area of the refluxer flow passage uniformly increases in the direction from the inlet of the refluxer flow passage to the outlet of the refluxer flow passage.

* * * * *